US005139129A

United States Patent [19]

DiLuciano

[11] Patent Number: 5,139,129

[45] Date of Patent: Aug. 18, 1992

[54] COIN CHUTE

[75] Inventor: Mark A. DiLuciano, Wakeman, Ohio

[73] Assignee: Sunmark Business Products, Inc., Lorain, Ohio

[21] Appl. No.: 677,522

[22] Filed: Mar. 29, 1991

[51] Int. Cl.[5] ..... G07F 1/04

[52] U.S. Cl. ..... 194/338; 194/347

[58] Field of Search ..... 194/334, 338, 347, 348, 194/349; 453/3, 5, 9, 14, 15; 193/DIG. 1

[56] References Cited

U.S. PATENT DOCUMENTS 446,303 2/1891 Thompson ..... 194/347 X
775,256 11/1904 Southwick ..... 194/338

FOREIGN PATENT DOCUMENTS 0476324 2/1976 Australia ..... 194/348
915280 7/1954 Fed. Rep. of Germany ..... 194/338
0595982 10/1925 France ..... 194/338

*Primary Examiner*—F. J. Bartuska
*Attorney, Agent, or Firm*—Pearne, Gordon, McCoy & Granger

[57] ABSTRACT

A plate is provided with a horizontal coin slot. The slot has a lower wall at an angle of about 45° and a upper wall parallel to the lower wall. Two rails having facing coin-retaining grooves running end-to-end are attached to the rear of the plate at opposite ends of the slot. The grooves slope downwardly from the slot at the same angle as the lower wall of the slot. Desired coins follow the chute formed by the slot and grooves, while undersized coins and foreign objects fall between the rails. A coin-orienting member may be added above the rails to help orient the coin in the chute.

4 Claims, 1 Drawing Sheet

COIN CHUTE

BACKGROUND OF THE INVENTION

1. Field of the Invention

This invention relates to coin chutes for coin-operated devices. In particular, the invention relates to a coin chute that allows foreign objects and coins smaller than a desired coin to be rejected.

2. Description of the Prior Art

Coin-operated machines are often the target of vandals, pranksters and thieves. Over the years many devices have been developed to try to eliminate or minimize the efforts of these miscreants.

U.S. Pat. No. 2,048,402 shows a nearly vertical coin chute formed from a sandwich of slotted plates fed by a port that allows coins to be inserted from a direction perpendicular to the chute. A valid coin is always held in the chute, such that it presents an obstacle to a smaller coin which then falls out of the chute through one of the slots.

U.S. Pat. No. 2,014,505 shows a coin chute also constructed of a sandwich of slotted plates. Like many known chutes, the coins essentially roll on edge down the chute. A series of ports in the edge of the chute permits a coin to roll across, but allows foreign matter, such as salt, to fall through.

None of these devices provide an effective way of preventing the jamming of the chute with foreign matter such as large wads of paper or similar material.

SUMMARY OF THE INVENTION

The present invention provides a coin chute apparatus that reliably rejects improperly sized coins and foreign objects.

Not only are simple foreign objects rejected, but "springy" objects such as folded paper, paper clips and other similar articles are either cleared immediately or by the insertion of the next coin.

The present invention provides the maximum possible reliable rejection area and orients that area so that gravity easily rejects undesired objects.

The coin chute apparatus includes a plate having a front surface, a rear surface and a coin slot through the plate from the first surface to the second surface. The slot has a left wall, a right wall, a top wall, a bottom wall and has its longest dimension in a substantially horizontal direction during use. The bottom wall slopes downwardly from the front surface to the rear surface at an angle of between 42.5° and 47.5° with respect to horizontal during use.

A first rail is attached to the rear surface of the plate adjacent to the left wall of the slot and a second rail is attached to the rear surface of the plate adjacent to the right wall of the slot. The rails have facing coin grooves aligned with the slot and extending the length of the rails. The grooves are parallel and extend from the plate at the angle of the bottom wall. They have a depth substantially less than the distance between the rails.

The slot and rails form a coin chute adapted to guide a desired coin from the slot to the end of the rails while allowing smaller coins and foreign objects to fall between the rails. By having the chute oriented at close to 45°, an optimum trade off is made between the gravitational force acting to reject undesired objects and that acting to move a desired coin down the chute.

In the preferred embodiment, the apparatus includes a coin-orienting member mounted above and between the grooves and extending from above the slot along a portion of the chute. For example, the coin-orienting member may be a first bar attached between the rails and a second bar attached between the rear surface above the slot and to a midpoint of the first bar.

DESCRIPTION OF THE PREFERRED EMBODIMENTS

Figure 1:
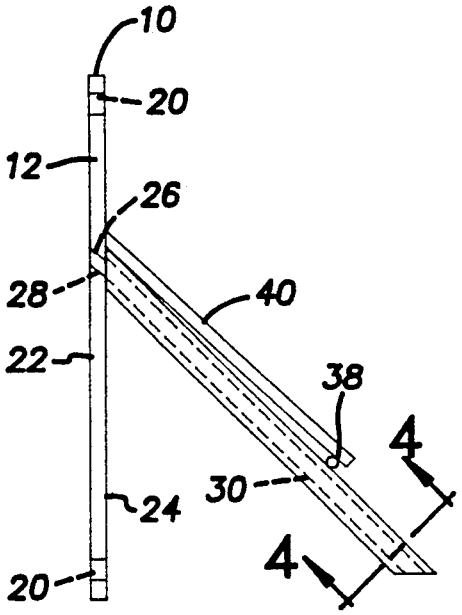
FIG. 1 is a side elevation view of coin slot apparatus according to the invention.
Figure 2:
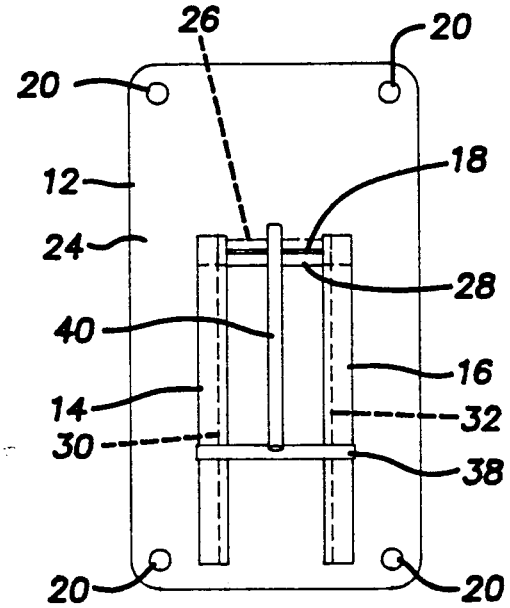
FIG. 2 is a rear elevation view of a coin slot apparatus according to the invention.
Figure 3:
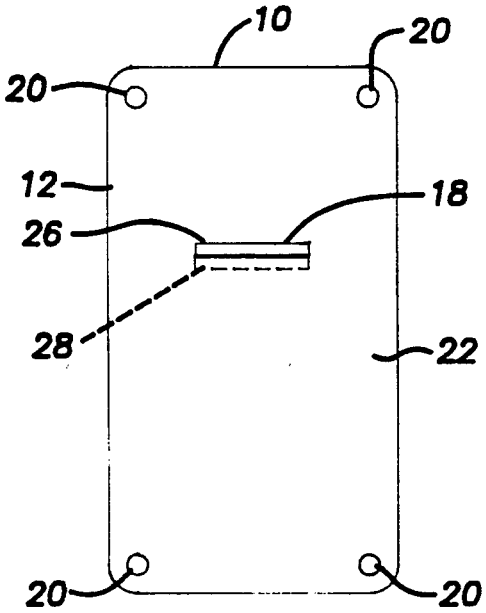
FIG. 3 is a front elevation view of a coin slot apparatus according to the invention.

Referring to FIGS. 1, 2 and 3, a coin slot apparatus 10 is formed from a plate 12 and rails 14, 16.

The plate 12 contains a slot 18 and mounting holes 20. The plate may be, for example, 14-gauge steel.

The slot 18 extends through the plate 12 from the front surface 22 to the rear surface 24. The bottom wall 28 of the slot 18 slopes downward from the front surface 22 towards the rear surface 24 of the plate 12. In the preferred embodiment, the slope is between 42.5° and 47.5° during use of the apparatus 10.

The top wall 26 of the slot 18 is preferably substantially parallel to the bottom wall 28 (e.g. within 2°), but may be made to approach horizontal if a wider acceptance angle for the slot 18 is desirable.

The slot 18 may be advantageously machined using a high-power laser.

If the apparatus 10 is to be used for U.S. quarters, the slot 18 may be, for example, 0.980–0.982 inches wide and 0.112 inches high at the front surface 22.

The rails 14, 16 are attached to the rear surface 24 of the plate 12 adjacent respective ends of the slot 18. The rails 14, 16 may be, for example, made of steel and the attachment by welding.

Figure 4:
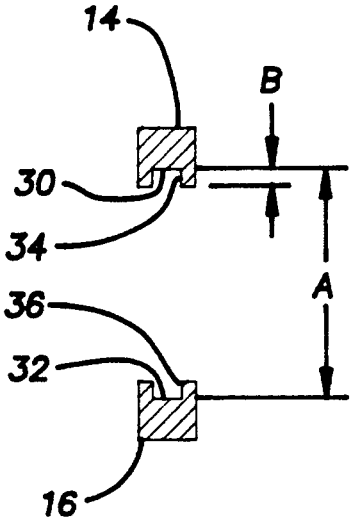
FIG. 4 is a cross sectional view in expanded scale taken along the line 2—2 of FIG. 1.

Referring to FIG. 4, the rails 14, 16 have respective coin grooves 30, 32 running along their lengths. The depth B of the grooves 30, 32 is substantially less than the distance A between the bottoms of the grooves 30, 32 (e.g. 5–10 percent).

The grooves 30, 32 slope downward from the rear surface 24 of the plate 12 at an angle parallel to that of the bottom wall 28 of the slot 18. The slot 18 is centered between the bottoms of the grooves 30, 32 and the bottom wall 28 of the slot 18 is even with bottom walls 34, 36, respectively, of the grooves 30, 32. The grooves 30, 32 are parallel to each other, maintaining the distance A along their respective lengths.

If the apparatus 10 is to be used for U.S. quarters, the grooves 30, 32 may have, for example, a depth B of 0.075 inches and a width of 0.125 inches. The distance A may be, for example, 0.975–0.980 inches.

A support rod 38 is attached between the rails 14, 16 on their upper surface. A coin-orienting rod 40 is attached at one end to the rear surface 24 of the plate 12 just above and centered on the slot 18. The other end of the rod 40 is attached to the rod 38 at the midpoint between the grooves 30, 32. The rods may be, for example, made of steel and the attachment by welding. In the preferred embodiment, the rods 38, 40 are of circular cross section, thereby minimizing the opportunity for the jamming of both desired coins and foreign objects.

The rod 38 is located at a distance from the rear surface 24 such that any foreign objects falls between the rails 14, 16 or any desired coin is oriented parallel to the grooves 30, 32 prior to either reaching the rod 38.

In operation, a desired coin may be inserted into the coin slot apparatus 10 through the slot 18 from the front surface 22. In the preferred embodiment, the dimensions of the slot 18 are such that the leading edge of the coin may only be inserted at an angle of roughly 45° downward. As the coin enters the slot 18, the leading edge of the coin contacts the rod 40 urging the coin into the grooves 30, 32.

Once through the slot 18, the coin slides along the grooves 30, 32, riding on their bottom walls 34, 36, respectively, the coin being supported at its edges. An electrical switch may be attached to either rail 14, 16 to sense the passage of the coin, or the coin may pass from the coin chute apparatus 10 to additional coin processing devices.

If an undersized coin or a foreign object is inserted into the slot 18, it falls between the large space between the rails 14, 16 for later disposition. As only the grooves 30, 32 are available to support the object, nearly all objects will fall easily between the rails 14, 16.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A coin chute apparatus comprising:

a plate having a front surface, a rear surface and a coin slot through said plate from said first surface to said second surface, said slot having a left wall, a right wall, a top wall, a bottom wall and having its longest dimension in a substantially horizontal direction during use, said bottom wall sloping downwardly from the front surface to the rear surface at an angle of between 42.5° and 47.5° with respect to horizontal during use;

a first rail having a first end and a second end, said first end being attached to the rear surface of said plate and being located adjacent to the left wall of said slot;

a second rail having a first end and a second end, said first end being attached to the rear surface of said plate and being located adjacent to the right wall of said slot, said rails having facing coin grooves aligned with said slot and extending from the first end to the second end of respective rails, said grooves being parallel and extending from said plate at the angle of said bottom wall and having a depth substantially less than the distance between said rails, wherein said slot and said rails form a coin chute adapted to guide a desired coin from said slot to said second ends while allowing smaller coins and foreign objects to fall between the rails; and a coin-orienting member mounted above and between said grooves and extending from above said slot along a portion of said chute.

2. A coin chute apparatus according to claim 1, wherein said coin-orienting member comprises a first bar attached between said rails and a second bar attached between said rear surface above said slot and to a midpoint of said first bar.

3. A coin chute apparatus according to claim 2, wherein said bars have a circular cross section.

4. A coin chute apparatus comprising:

a flat plate having a front surface, a rear surface and a coin slot through said plate from said first surface to said second surface, said slot having a left wall, a right wall, a top wall, a bottom wall and having its longest dimension in a substantially horizontal direction during use, said bottom wall sloping downwardly from the front surface to the rear surface at an angle of between 42.5° and 47.5° with respect to horizontal during use;

a first rail having a first end and a second end, said first end being attached to the rear surface of said plate and being located adjacent to the left wall of said slot;

a second rail having a first end and a second end, said first end being attached to the rear surface of said plate and being located adjacent to the right wall of said slot, said rails having facing coin grooves aligned with said slot and extending from the first end to the second end of respective rails, said grooves being parallel and extending from said plate at the angle of said bottom wall and having a depth substantially less than the distance between said rails; and a coin-orienting member mounted above and between said grooves and extending from above said slot along a portion of said chute, said coin-orienting member having a first circular bar attached between said rails and a second circular bar attached between said rear surface above said slot and to a midpoint of said first bar, wherein said slot, said rails and said coin-orienting member form a coin chute adapted to guide a desired coin from said slot to said second ends while allowing smaller coins and foreign objects to fall between the rails.

* * * * *